US006495069B1

(12) United States Patent
Lussey et al.

(10) Patent No.: US 6,495,069 B1
(45) **Date of Patent: *Dec. 17, 2002**

(54) POLYMER COMPOSITION

(75) Inventors: David Lussey, Richmond (GB); Andrew Brian King, Thirsk (GB); Christopher John Lussey, Richmond (GB)

(73) Assignee: Peratech Limited of a Company of Great Britain and Northern Ireland, Darlington (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/600,808

(22) PCT Filed: Jan. 21, 1999

(86) PCT No.: PCT/GB99/00205

§ 371 (c)(1),
(2), (4) Date: Jul. 24, 2000

(87) PCT Pub. No.: WO99/38173

PCT Pub. Date: Jul. 29, 1999

(30) Foreign Application Priority Data

| | | |
|---|---|---|
| Jan. 30, 1998 | (WO) | WO 98/33193 |
| Mar. 28, 1998 | (GB) | 9806623 |
| Jun. 30, 1998 | (GB) | 9814131 |

(51) Int. Cl.[7] ..... H01B 1/22; B05D 5/12

(52) U.S. Cl. ..... 252/512; 252/62.9 PZ; 428/403; 428/407; 428/901; 427/96

(58) Field of Search ..... 252/511, 512, 252/513, 514, 62.9 PZ; 428/403, 407, 901; 427/96

(56) References Cited

U.S. PATENT DOCUMENTS

| | | | | |
|---|---|---|---|---|
| 3,180,012 | A | | 4/1965 | Smith |
| 4,028,276 | A | | 6/1977 | Harden et al. |
| 4,120,828 | A | * | 10/1978 | Michalchik ..... 252/513 |
| 5,106,540 | A | | 4/1992 | Barma et al. |
| 5,213,715 | A | * | 5/1993 | Patterson et al. ..... 252/518 |
| 5,589,222 | A | | 12/1996 | Thometzek et al. |
| 5,591,382 | A | | 1/1997 | Nahass et al. |
| 5,643,502 | A | | 7/1997 | Nahass et al. |
| 5,651,922 | A | | 7/1997 | Nahass et al. |
| 5,686,158 | A | | 11/1997 | Gibbon |
| 5,965,064 | A | * | 10/1999 | Yamada et al. ..... 252/512 |
| 6,291,568 | B1 | | 9/2001 | Lussey |
| 6,335,077 | B1 | * | 1/2002 | Tani et al. ..... 428/138 |

FOREIGN PATENT DOCUMENTS

| | | | |
|---|---|---|---|
| DE | 43 15 382 | | 6/1992 |
| DE | 195 10 100 | | 9/1996 |
| GB | 2054277 | * | 2/1981 |

* cited by examiner

*Primary Examiner*—Mark Kopec
(74) *Attorney, Agent, or Firm*—Larson & Taylor PLC

(57) ABSTRACT

A polymer composition comprises at least one substantially non-conductive polymer and at least one electrically conductive filler and in the form of granules, the granules preferably being in the size range up to 1 mm and more preferably between 0.04 mm and 0.2 mm, with the volume ratio of conductor to polymer preferably being at least 3:1.

34 Claims, 1 Drawing Sheet

POLYMER COMPOSITION

TECHNICAL FIELD

Figure 1A:
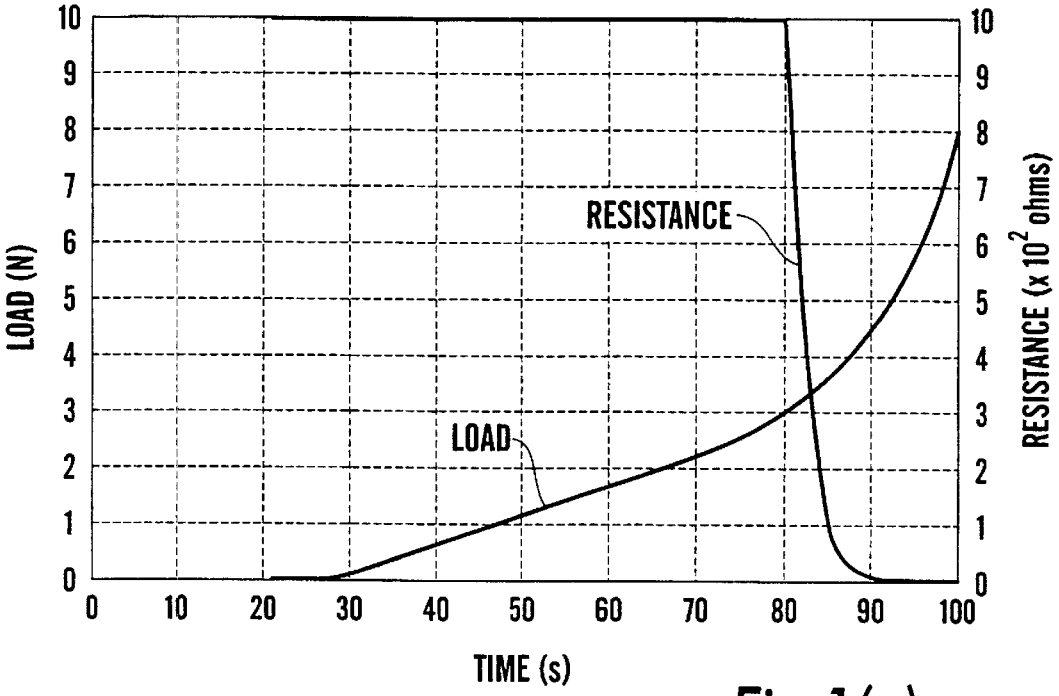

This invention relates to a polymer composition including a finely divided electrical conductor, particularly comprising such a composition in an advantageous physical form.

BACKGROUND ART

The use of such a composition has been proposed for devices for controlling or switching electric current, to avoid or limit disadvantages such as the generation of transients and sparks which are associated with the actuation of conventional mechanical switches. In particular, co-pending application PCT/GB98/00206 dated Jan. 23, 1998 and subsequently published under serial number WO98/33193, discloses such a composition and switches based on it. That application discloses for the first time a granular composition containing polymer and conductive filler. The present application relates to a polymer composition in that form and to further developments thereof.

DE-A-4315382, to which corresponds U.S. Pat. No. 5,589,222, discloses hydrophobic flowable granules comprising hydrophilic inorganic powder and 0.03 to 15% w/w of hydrophobic polyorganosiloxan and a process of producing them by mixing the powder in a granulator with an aqueous emulsion of the polyorganosiloxan and drying the resulting product at elevated temperature. Among the powders listed are metals and alloys. The granules are, however, for use in enamelling; there is no disclosure that they might form part of an electrical circuit or, further, that they could be electrically insulating when quiescent but conducting when subject to mechanical stress or electrostatic field.

SUMMARY OF THE INVENTION

According to the present invention there is provided an electrical conductor composite providing conduction when subjected to mechanical stress or electrostatic charge but electrically insulating when quiescent comprising a granular composition each granule of which comprises at least one substantially non-conductive polymer and at least one electrically conductive filler and is electrically insulating when quiescent but conductive when subjected to mechanical stress or electrostatic charge.

The granules are typically in the size range up to 1 mm, especially 0.04 to 0.2 mm. Thus the smaller granules behave as powders. These ranges are based on measuring the greater diameter of the granules if not regularly spherical. To suit user's requirements, the granules may be for example in an approximate Poisson size distribution, or sieved to a skewed distribution or a narrow spread (for example, largest granules no greater than 2×smallest) or classified so that small granules fill the spaces between larger granules.

Within the granules the conductor:polymer volumetric ratio (tapped bulk:voidless solid) is suitably at least 3:1. For the ratio of conductive medium to polymer small changes will be required to account for differences in relative surface tensions of types and grades of polymer and the various surface energies of the different conductive oxides and other solids present. Changes of this ratio have an effect on the piezo-charge properties, the overall resistance range, the recovery hysteresis and the pressure sensitivity of the granules.

In general the conductive material can be one or more metals, other conductive or semiconductive elements and oxides or intrinsically conductive or semiconductive organic or inorganic polymers. Thus it is suitably selected from powdered forms of the metallic elements or their electrically conductive alloys or reduced oxides either on their own or together. More specifically it is one or more of titanium, tantalum, zirconium, vanadium, niobium, hafnium, aluminium, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and, if appropriate, at least one electroconductive agent. The conducting filler can be the basic element in the unoxidised state; or can be a layer on a carrier core of powder, grains, fibres or other shaped forms. The oxides can be mixtures comprising sintered powders of an oxycompound. The alloy may be for example titanium diboride.

The micro-structure of the conductor particles is of substantial importance. Thus dendritic, filamentous, and spiked forms of the conductive materials have been shown to be capable of producing particularly sensitive granules when coated with a polymer such as silicone. Generally the conductor particles are rough-surfaced with smaller and spikier powders producing more sensitive granules. Preferably the particles comprise metal having at least one of these characteristics:

(i) spiky and/or dendritic surface texture;

(ii) filamentary structure, with a three-dimensional chain-like network of spiky beads, the chains being on average 2.5–3.5 microns in cross-section and possibly more than 15–20 microns in length.

Generally these characteristics are present in the conductor particles before mixing with polymer, and mixing is controlled to substantially preserve them.

As described further below, preferred conductor particles comprise carbonyl-derived metallic nickel. Other examples include dendritic copper.

The polymer constituent of the granules can be chosen from a wide range of materials, the only limitation being that the polymer or a precursor thereof should be available in a form sufficiently mobile to permit incorporation of conductor particles. In an extreme case it can be a fully or partly cured resin, such as a formaldehyde condensate, epoxy resin, maleimide resin or 3-dimensional olefin resin. Polymers having flexibility, such as linear thermoplasts, are of more general application. Very suitably the polymer constituent is an elastomer. Since elastomers are preferred in certain composites including the granules, they will be described further below.

The invention provides a method of making the granules by mixing conductor particles with liquid-form polymer in granule-forming conditions. The liquid-form polymer may be, for example, a precursor subject to polymerization or to cross-linking during the granule-forming step or later. Liquid-form means sufficiently flowable to undergo mixing with the conductor particles. The polymer may be very viscous. A liquid may be present to modify the viscosity of the polymer as an aid to mixing. It may be added, for example, by pre-mixing with the polymer or with the conductor powder. The liquid should of course be chemically inert with respect to the conductor and polymer. Preferably it is volatile, that is, has an atmospheric pressure boiling point under 120° C., to assist removal during and after mixing. Hydrocarbons, such as petroleum distillates, are very suitable. Before or during mixing there may be added a hydrophobising agent. This is believed to act by displacing adsorbed water from the surfaces of the components of the mix, for example the conductor particles, solid additives such as those described below, especially fumed silica, and possibly of newly exposed polymer and newly formed granules. The agent may also act as a lubricant limiting friction-at mixer surfaces. Since it can act by formation of very thin, even unimolecular layers, the quantity to be used is very small, for example 10–1000 ppm w/w of the mix. Examples of the agent are liquid hydrocarbons carrying groups favouring chemisorption on metals, and fluorocarbons.

The granules are made by coating conductive particles with a layer of polymer in a controlled mixing regime that imparts only sufficient force to the components of the mix to achieve the coating process and avoids additional force which has been found to have a degrading effect on the electrical properties of the final polymer composition. The relationship between filler, binder, mixing energy, time, rate of shear, temperature and pressure determine the particle size-distribution and electromechanical properties of the resulting granule. It appears likely that the conductor particles act as nuclei for granule formation. Such mixing is preferably at a low level of shear, so that the conductor particles remain structurally intact. Suitably a dish-granulator, blunger, coaxial cylinder mixer (rotary ablation) can be used. In the granule-forming step it appears that the total shear can be of the same order as in the production of bulk composition but applied at greater intensity for a shorter time. Granule formation is preferably accompanied by some cross-linking of the polymer. The polymer formulation is chosen and the conditions of mixing are controlled so that breakage of the mixture into granules is synchronized with cross-linkage of the polymer sufficient for a non-sticky state. This is especially convenient using RTV silicone. The process may if desired be controlled to produce a precursor of the granules in which the polymer may be subjected to further cross-linking to develop elastomerism. Use of HTV silicone affords more scope in making such precursors. The silicone very suitably is one subject to high shrinkage for example by 10–20% on cross-linking. This makes possible a relatively high conductor to polymer volume ratio in granules without an inconveniently high ratio at the start of mixing.

If the silicone content of the mix is increased, sensitivity is decreased and agglomeration increases. If high silicone content is required, silicone may be applied to previously made granules of lower silicone content. In rotary ablation the clearance setting of the pestle against the mortar, and the pressure applied to the pestle, are mechanically adjusted to achieve the required conditions. This pressure affects the time taken to achieve the granulated state and is important to the coating thickness, the eventual size of the granule and the amount of agglomeration between individual granules. Too much pressure produces destructive shear forces.

The resulting granules can be comminuted to provide a desired range. They can be screened to separate the different sized agglomerations if required. Different sized granules show different sensitivities; granule sizes can be separated and remixed in different proportions to alter the final sensitivity of the granule composite. It has also been found possible to combine different conductive materials, conductive, semi-conductive or non-conductive powders, prior to the granule-forming agglomeration/coating process to obtain the required conduction or other electrical and mechanical properties in the final granule form.

The invention provides also a composite comprising the granules. Generally the granules can be used by containing them in a device which limits peripheral movement but allows the input of an electrical or mechanical pressure in order to activate it. They may be mixed with or coated onto other bulk or foamed polymers to form solid, semi-flexible or flexible composite structures. For one type of structure, the granules can be extruded or pressed into sheet, pellet or fibre form or can be cast into moulds. In the course of the shaping process they can be milled or cryogenically powdered. Energy imparted during mixing and moulding the polymer composition in the uncured state may, however, affect the physical and electrical performance of the composite.

For a second type of composite, the granules may be associated with a containing means. This may be a fibre or sheet, for example of polymer fibre film, plate or cloth and may carry granules on one or both faces. The polymer sheet may already contain or carry conductor particles as described for example in Example 7 of the co-pending application. The sheet may comprise or carry an adhesive for the granules.

In another method of forming such a composite, precursor granules (as specified above) can be pressed into the surface or surfaces of the un-cross-linked carrier polymer and permanently bonded to the carrier polymer when it is cross-linked. This produces a pressure sensitive or EM screening layer on the carrier polymer.

For a third type of composite the granules are associated with a three-dimensional matrix. The matrix may be electrically non-conducting, but could be composed, for example, of polymer having conductor particles dispersed in it, such as described in the co-pending application or in prior-published documents. Several variants of this type are possible, for example:

(i) added granules individually conducting or non-conducting or mixed;

(ii) matrix material differing in degree of cross-linking from granule polymer;

(iii) matrix material may enter spaces between granules or may be just a containment bag.

In a particular example of the third type, in which the polymer composition may be in bulk form as described in the co-pending application or, preferably, introduced in granule form as follows:

in a composite structure for generation, detection and relay of electrical signals internal connectivity is provided in the form of an integrated electrically conductive member for example a layer such as metal film or sheet especially continuous metallised cloth, typically polyester based. The cloth increases the tactile sensitivity (increase in resistance drop versus mass loading) of the conductive polymer composition by providing a hard fibre anvil for elastomeric distortion and provides an electron bridge between zones of low resistance within the composite. The polymer composition can be bonded to or formed on the conductive member.

Whereas the composite may be a simple device for switching on when deformed, more complicated electrical circuits may be built into the layer, for example, of the metallised cloth structure. The metal coated fabric is typically manufactured by application of metal by vapour deposition, sputtering or similar means to a woven polyester cloth.

Electrical circuits, analogous to those etched onto a conventional printed circuit board, may be created by masking and etching the pre-metallised cloth or preferably by masking the target cloth at the point of metallisation.

In the latter example the metal coating will only be deposited where the mask allows and by this process a conductive circuit layout can be produced.

Composites incorporating the circuit cloth show true flexibility, are solid state and may be made extremely sensitive to touch or other operating forces. They may be used for digital and analogue switching and control, may incorporate PTC load control or heat production capability and have the capacity to carry substantial electric currents.

Whichever type of composite is in view, a particularly useful one comprises the granules and includes means for the input of electrical and/or mechanical deformation to activate it. Thus the sheet or matrix would comprise ohmic conductor(s) connecting the granule assembly electrically.

The granules can also be used as a component of other conductive and electromagnetic shielding materials either alone or in combination with other powders or granules or other non-conductive, semiconductive or conductive materials.

Granule-coated surfaces can be particularly sensitive to applied pressure, increasing in pressure sensitivity with increasing surface loading. Granules on their own and granule-coated surfaces can show a drop in electrical resistance of more than $10^{12}$ ohms with an applied force within the range 0.01–6 N/cm$^2$.

Whichever type of composite is being made, it is preferred to have hydrophobising agent, as above described, present when an assembly of the granules is being set up.

Composites containing the granules as a film or heterogeneous mixture with other polymers and materials tend to show greater repeatability, sensitivity and linearity of resistance change than can be obtained with bulk pressure sensitive polymer compositions as in the co-pending application. Like the bulk composition, the granules return to a quiescent resistance state when the operating force is removed.

For the granules and/or the matrix (especially if conducting), very suitably the polymer constituent is an elastomer, especially having the general properties:

i) low surface energy typically in the range 15–50 dyne/cm but especially 22–30 dyne/cm;

ii) a surface energy of wetting for hardened elastomer higher than its uncured liquid;

iii) a low energy of rotation (close to zero) giving extreme flexibility;

iv) excellent pressure sensitive tack both to the filler particles and electrical contacts to which the composite may be attached—that is, possess a high ratio of viscous to elastic properties at time spans comparable to bonding times (fraction of a second);

v) high on the triboelectric series as a positive charge carrier (conversely, will not carry negative charge on its surface);

vi) chemically inert, fire extinguishing and effective as a barrier to oxygen and air ingress.

Silicone elastomer rubbers are typically but not exclusively based on polydimethylsiloxane, polysilamine and allied silicone backbone polymers, with leaving groups, cross-linkers and cure systems based on:

| Leaving Group | Cross Linker | Cure System |
|---|---|---|
| $HOC(O)CH_3$ | $CH_3Si[OC(O)CH_3]_3$ | ACETIC ACID |
| $HOCH_3$ | $CH_3Si(OCH_3)_3$ | ALCOHOL |
| $HONC(CH_3)(C_2H_5)$ | $CH_3Si[ONC(CH_3)C_2H_5]_3$ | OXIME |
| $CH_3C(O)CH_3$ | $CH_3Si[CH_2C(O)CH_3]_3$ | ACETONE |
| $HN(CH_3)C(O)C_6H_5$ | $CH_3Si[N(CH_3)C(O)C_6H_5]_3$ | BENZAMIDE |

meet all the above mentioned property criteria. The elastomer can be mixtures comprising cured elastomers selected from the group comprising one, two or more component silicones, one, two or more component polygermanes and polyphosphazines and at least one silicone agent. In such polymer mixtures, the silicone component exceeds other polymer components.

Other additives are included with the silicone for the purpose of modifying the physical and/or electrical properties of the uncured or cured polymer composition. Such additives can include at least one property modifier from the group comprising: alkyl and hydroxyalkycellulose, carboxymethylcellulose, hydroxyethylcellulose, hydroxypropylcellulose, polyacrylamide, polyethylene glycol, poly (ethylene oxide), polyvinyl alcohol, polyvinylpyrrolidone, starch and its modifications, calcium carbonate, fumed silica, silica gel and silicone analogues and at least one silica analogue or silicone analogue modifier. Fumed silica is an example of a modifier as commonly used in elastomer technology. For this invention, in proportions of between 0.01–20% by weight of the final polymer composition, it acts as a recovery-enhancing filler, that is, it increases the resilience of the polymer composition to accelerate the return of the composition to its quiescent state after any applied force is released. A preferred example of a silicone system is manufactured from high strength room temperature cured fumed silica loaded (RTV) silicone polymer. Another example uses high temperature cured HTV silicone filled with fumed silica to provide interstitial structure, useful strength, pressure tack and life, cross-linked at an elevated temperature in the presence of a peroxide or other catalyst, that may typically but not exclusively be 2,4 dichloro dibenzoyl peroxide. Such HTV products may be stored for prolonged periods in the uncured state prior to processing into sheet, rod, foam, fibre, press moulded or other forms.

Another usable class of elastomer is the natural or synthetic hydrocarbon rubbers. Especially for matrix material, such rubber may be introduced in latex form.

The resulting composites may display a piezo-charge affect and will change their inherent electrical resistance in response to both pressure and strain forces. Working resistance is around the range $10^{12}$ to $10^{-1}$ ohms and the composite have excellent current carrying capability; typically a 2 mm thick sample of the composite on a heat-sink can control AC or DC currents of 3 A/cm$^2$. The initial application of pressure or force to a sample of the high-resistance composite results in the generation of an electrostatic charge; increasing the pressure or force decreases the electrical resistance of the composite. The composites can be flexible and can reassert themselves when the force or pressure is removed. As this occurs the electrical resistance will increase towards a quiescent value and a pronounced electrostatic charge will develop. The electrostatic effect can provide digital switching indications or provide a voltage source. The electrical resistance change can provide an analogue of the applied pressure or force. Alternatively, the resistance range can be used to provide digital switching especially but not essentially at its upper and lower limits. Sensitive versions of composite which are close to conduction, can be changed into a fully conducting state by applying an electrostatic charge, typically that generated by a piezoelectric spark generator and greater than 0.5 kV.

The composite may consist of the granules held within a matrix. Within the granules the conductive particles are of such a size distribution as to provide for a close packed structure with interstitial particle infilling. Voids present in the bulk conductor powder become infilled with elastomer during mixing and conductor particles become set in close proximity during curing. In order to achieve this structural arrangement the elastomer will have a low surface energy relative to the powder phase and uncured liquid surface energy less than cured elastomer surface energy. Such polymer compositions will include silicones, polygermanes and polyphosphazines. In the stressed state the distortion takes place such that the average entrapped inter-particle distance decreases. For metal particles this corresponds to an increase in electrical conductivity, for other types of particle other effects may be generated (change in ferromagnetism, piezoelectricity, ionic conduction, etc.).

For metal filled compositions over the transition from unstressed to stressed state, bulk conductivity will change from that of the elastomer to that of the entrapped conductor particles. At a certain level of distortion the number of particle-to-particle open-circuit tracks results in a conductivity tending towards that of the bulk metal resistivity. Since this effect is ultimately related to distortion of the bulk composite, and since the bulk material is highly elastomeric and therefore energy absorbing, low 'metallic' conductivity may only be achieved for thin sections (less than 2 mm in lateral dimension) of the composite material or upon application of high external stress or strain or torque. Upon removal of external force the material reverts to its original structure whereby entrapped particles are held apart within an elastic insulating network.

Surprisingly, the assembly of granules is capable of carrying significant electrical current. Up to 30 amps continuous load has been carried by a 2×2 cm conductor to date when in a compressed state. This unique property may be explained by the fact that in the compressed state conduction occurs principally through the metal bridges described above. So for the purpose of explaining conduction the materials are best described in terms of a heterogeneous mixture in which the insulative encapsulant dominates electrical property in the quiescent state; and tending towards that of the conductor bridges (having a local resistivity tending to that of the conductor typically 1–1000 microhm-cm), in the compressed state (typically having a bulk resistivity greater than 1 milliohm-cm). Electron conduction is further confined to the conductor filler by the inability of the encapsulant to hold negative 'electron' charge (typically the encapsulant is the optimal positive triboelectric charge carrier). For fixed composition the statistical chance of bridge formation is directly related to composite thickness. Thus both the sensitivity to distortion and current carrying capability increase with reduction in thickness with the thinnest films limited by the filler size distribution. For the mixtures described below the filler size distribution will typically limit thickness to >10–40 microns.

By incorporation of zirconium particles (or other ionic conducting materials) into a silicone elastomer, within and/or between granules, the composite may be made to conduct both electrons and, in the presence of gaseous oxygen, oxygen ions. By control of bulk material stress (for example by the incorporation of static or externally resonated 'stress grids' into the bulk composition) conduction of electrons and oxygen may be made to occur in different planes or different parts of the bulk structure. Such properties may be of particular interest in the design of fuel cell systems. It has also been found that internal ohmic heating may affect the internal structure of the composite. So for example in compositions encompassing nickel as conductive filler, RTV silicone encapsulant and fumed silica skeletal modifier, it is found that the differential expansion of the encapsulant relative to the conductor is of such proportion (typically, the encapsulant expands fourteen times faster than the conductor) that upon passage of high current, sufficient to create ohmic heating, differential expansion alters the stress/strain versus resistance transition. This effect may be induced at low differential temperatures (typically less than 100° C.). This effect (which induces a positive temperature coefficient of resistance (PTC) in the composite phase) may be conveniently employed for the purpose of regulating current flow. Onset of PTC may be regulated by increasing or decreasing mechanical pressure on the polymer composition. Alternatively, for composites that have a low electrical resistance (typically <100 ohms) in the quiescent state, ohmic heating switches by virtue of the PTC effect between conducting and insulating states in a composition that is under little or no compressive force. This effect allows these polymer compositions to be used as switches or fuses which switch sharply to a high resistance state in response to excess current and which, because of their elastomeric nature, will return to a conductive state without the removal of power when the current flow returns to a set value. This PTC effect can also be used in self-regulating heating elements where heat levels can be set by applying mechanical pressure to keep the polymer composition close to its PTC point at the required temperature. The polymer composition will maintain a relatively steady temperature by cycling in and out of the PTC phase. The composition has wide temperature tolerance and good thermal conductivity.

A nickel powder used in the invention was INCO Type 287 which has the following properties: beads are on average 2.5–3.5 microns in cross-section; chains may be more than 15–20 microns in length. It is a filamentary powder with a three-dimensional chain-like network of spiky beads having a high surface area.

DETAILED DESCRIPTION OF THE INVENTION

Example 1

Granules were prepared from:

| | |
|---|---|
| INCO nickel powder 287 | 28 g |
| ALFAS Industries RTV silicone type 2000 | 4 g |

[This weight ratio corresponds approximately to a nickel: polymer volume ratio of 8.24:1 based on the tapped bulk volume of the nickel and the voidless volume of the silicone]

The silicone as a soft lump was placed in the bottom of a RETSCH RM100 motorized mixer having a steel mortar and a porcelain rotary pestle. The nickel powder was placed around the lump of silicone. The pestle was lowered under hand control with an approximate 1 mm clearance from the wall of the mortar. This machine subjects the mixture to rotary ablation. In about 5 minutes the silicone coated the nickel particles and in so doing became resolved into granules having the following size distribution % w/w in microns:

| Size fraction | % w/w |
|---|---|
| +152 | 32 |
| 152 to 75 | 33 |
| 75 to 45 | 32 |
| −45 | less than 3 |

Completion of granule formation was evident from a change in the colour and texture of the mixture. During mixing, the cross-linking reaction of the silicone produced the odour of acetic acid; this could be continued further if desired, but mixing was stopped when or soon after the granules had been formed, to avoid risking shear damage to the nickel particles in the granules.

The granules are non-conductive in the quiescent state but are very sensitive to applied pressure.

Example 2

The procedure of Example 1 was repeated using:

| | |
|---|---|
| ALFAS Industries RTV silicone type 1000 | 6 g |
| INCO nickel powder 287 | 30 g |

corresponding to a nickel: polymer ingredient volume ratio of approximately 5.88:1. Although the ratio is lower than in Example 1, the characteristic shrinkage on cross-linking of the grade of silicone used, resulted in granules electrically conductive without applied pressure. The shrinkage seems to be a product of the loss of volatile components at cross-linking. ALFAS 1000 contains 12% of volatile substances. (ALFAS 2000 contains 4% of volatile substances).

Such granules are for example of especial value in conductive adhesives, EM screening and PTC devices.

Example 3

Figure 1B:
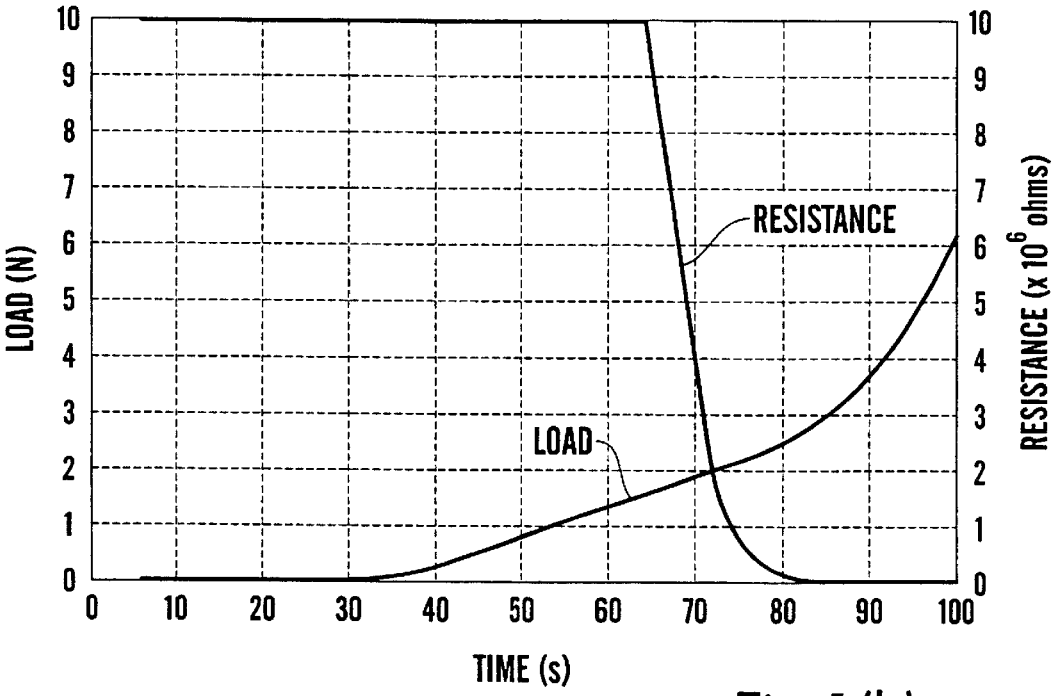

Example of a conductor based on the granules:

a test piece conductor was made by loading a sample of the granules prepared in Example 1 into a test cell consisting of a washer of silicone rubber sponge 12 mm in diameter, 3 mm thick and with a hole 6 mm in diameter, resting on an electrically conductive surface as lower electrode. A conductive plate was placed on top of the washer to form an upper electrode. The electrodes were connected via a constant-current 10 volt supply and a 20 M ohm high-impedance buffer amplifier to a Picoscope ADC 100 signal processor and recording device. To allow measured amounts of force to be applied to the test cell, it was placed on the platen of a load testing device, namely a Lloyd Instruments LRX fitted with a 100 N maximum force resolver. Slowly increasing pressure was applied to the cell and its resistance was recorded and represented graphically by the signal processor. Runs were carried out at two levels of current:

FIG. 1(*a*) 10 mA, (resistance in ohms$\times 10^2$), and

FIG. 1(*b*) 1 microA, (resistance in ohms$\times 10^6$),

The figures, in which load and resistance are plotted against time, show that as pressure increased the resistance of the granules in the cell decreased and caused a change in the potential difference (PD) voltage across the cell.

Example 4

Demonstration of non-ohmic conduction:

the test cell of Example 3 was compressed with a static loading of approximately 3 N, a current of 10 microAmps was passed through the test cell and its resistance, calculated from the potential difference (PD) across the cell, was 100K Ohms. Keeping the voltage and applied pressure constant, the current was increased to 100 microAmps. The measured PD now showed the resistance of the cell to have dropped to 50K ohms.

Example 5

Example 1 was repeated with the difference that the starting materials were:

| | |
|---|---|
| INCO nickel powder 287 | 30 g |
| Dow Corning HTV silicone (20 Shore) | 6 g |
| under 50° C. petroleum (lighter fuel) | 2 g |
| 2,4-dichloro-dibenzoyl peroxide | 200 mg |

Granules were formed at the end of about 5 minutes, during which the petroleum evaporated off and sufficient (but incomplete) cross-linking of the silicone took place. The granules were fully cross-linked by heating at 120° C. for 20 minutes and were then tested as described in Examples 3 and 4.

Example 6

Example 1 was repeated with the difference that, before being added to the mixer, the nickel powder was sprayed with an aerosol of the hydrophobising agent WD40 (RTM). The granules were tested as in Examples 3 and 4 and found to be substantially more sensitive than those prepared without the WD40.

Example 7

Granules made as in Example 1 were formulated as follows:

| | |
|---|---|
| 45–75 micron fraction | 0.225 g |
| 75–152 micron fraction | 0.225 g |
| 25% in water hexadecyl-trimethylammonium chloride | 0.1 g |
| Natural rubber latex (60% w/w) | 0.12 g |
| Water | 0.15 g |

The ingredients, excluding latex, were mixed to form a paste. The latex was added and further mixed to form a gel. The gel was split in two and applied through a stencil onto:

(a) copper coated polyimide printed circuit, and (b) nickel coated polyester cloth printed circuit.

The resulting structure was dried at 80–90° C. for 30 minutes, or until dry.

A similar result was obtained using dodecylbenzenesulphonate in place of the hexadecyl-trimeethylammonium chloride.

What is claimed is:

1. A granular composition each granule of which comprises at least one electrically non-conductive polymer and at least one electrically conductive filler selected from powder-form metallic elements and alloys, electrically conductive oxides of such elements and alloys, and mixtures thereof, and each said granule is reversibly actuatable by mechanical stress or electrostatic charge between an electrically insulating state when quiescent and a conductive state when subjected to said mechanical stress or said electrostatically charge.

2. A granular composition each granule of which comprises at least one electrically non-conductive polymer and at least one electrically conductive filler selected from powder-form metallic elements and alloys, electrically conductive oxides of such elements and alloys, and mixtures thereof, the conductive filler particles being formed from a void-bearing conductor powder the voids of which become infilled with polymer, setting the conductor particles in close proximity and being within each granule, coated with the polymer and structurally substantially intact compared with its structure before mixing the polymer, each said granule being reversibly actuatable by mechanical stress or electrostatic charge between an electrically insulating state when quiescent and a conductive state when subjected to said mechanical stress or said electrostatic charge.

3. An electrical conductor composite reversibly actuatable by mechanical stress or electrostatic charge between an electrically insulating state when quiescent and a conductive state when subjected to said mechanical stress or said electrostatic charge, said composite comprising:

a granular composition, each granule of which comprises at least one electrically non-conductive polymer and at least one electrically conductive filler selected from powder-form metallic elements and alloys, electrically conductive oxides of such elements and alloys, and mixtures thereof, and said composite is reversibly actuatable by mechanical stress or electrostatic charge between an electrically insulating state when quiescent and a conductive state when subjected to said mechanical stress or electrical charge.

4. The composite according to claim 3 wherein the conductive filler is, within each granule, coated with the polymer and structurally substantially intact compared with its structure before mixing with the polymer.

5. The composite according to claim 3 wherein the filler particles are formed from a void-bearing conductor powder, the voids of which become infilled with polymer during mixing with polymer, setting the conductor particles in close proximity.

6. The composite according to claim 3 wherein mechanical stress sets up particle-to-particle open-circuit tracks resulting in conductivity tending towards that of bulk material.

7. The composite according to claim 3 wherein the filler particles are formed from a conductor powder having a bulk density less than one third of its solid density.

8. The composite according to claim 3 in which conductance in the conductive state is non-ohmic.

9. The composite according to claim 3 wherein the conductive filler comprises metal having at least one of these characteristics:

spiky and/or dendritic surface texture;

filamentary structure.

10. The composite according to claim 9 wherein the filler comprises carbonyl-derived metallic nickel.

11. The composite according to claim 3 wherein the polymer is a silicone rubber comprising a recovery-enhancing filler.

12. The composite according to claim 3 wherein the granules are the product of mixing conductive filler particles with liquid-form polymer in granule-forming conditions at a low level of shear whereby the conductive filler particles remain substantially structurally intact.

13. The composite according to claim 3 wherein in such mixing and granule formation were accompanied by cross-linking of the polymer, and the polymer formulation selected and the conditions of mixing controlled so that breakage of the mixture into granules was synchronized with cross-linkage of the polymer sufficient for a non-sticky state.

14. The composite according to claim 3 further comprising a containing means for the granular composition, said containing means comprising a non-conducting matrix, or supporting sheet.

15. The composite according to claim 14 wherein said non-conducting matrix comprises an elastomeric material.

16. The composite according to claim 15 wherein said supporting sheet comprises a continuous metallized cloth.

17. An electrical circuit or electromagnetic shield comprising a conductor composite according to claim 3.

18. The circuit according to claim 17 which is a temperature sensor based on PTC and comprises mechanical or electrostatic means to bring the conductor composite to a conductive state when response to temperature is required, said composite providing a PTC effect by switching to an insulating state in response to thermal expansion due to excess current.

19. The circuit according to claim 18 which the means bringing the composite to the conductive state is or includes shrinkage of the polymer during preparation of the granules.

20. An electrical conductor composite reversibly actuatable by mechanical stress or electrostatic charge between an electrically insulating state when quiescent and a conductive state when subjected to said mechanical stress or electrical charge, said composite comprising:

a granular composition, each granule of which comprises at least one electrically non-conductive polymer and at least one electrically conductive filler selected from powder-form metallic elements and alloys, electrically conductive oxides of such elements and alloys, and mixtures thereof, the conductive filler particles being formed from a void-bearing conductor powder, the voids of which become infilled with polymer during mixing with polymer, setting the conductor particles in close proximity and being within each granule, coated with the polymer and structurally substantially intact compared with its structure before mixing with the polymer, each said granule being reversibly actuatable by mechanical stress or electrostatic charge between an electrically insulating state when quiescent and a conductive state when subjected to said mechanical stress or electrostatic charge.

21. The composite according to claim 20 wherein mechanical stress sets up particle-to-particle open-circuit tracks resulting in conductivity tending towards that of bulk material.

22. The composite according to claimed 20 wherein the filler particles are formed from a conductor powder having a bulk density less than one third of its solid density.

23. The composite according to claim 20 in which conductance in the conductive state is non-ohmic.

24. The composite according to claim 20 wherein the conductive filler comprises metal having at least one of these characteristics:

spiky and/or dendritic surface texture;

filamentary structure.

25. The composite according to claim 24 wherein the filler comprises carbonyl-derived metallic nickel.

26. The composite according to claim 20 wherein the polymer is a silicone rubber comprising a recovery-enhancing filler.

27. The composite according to claim 20 wherein the granules are the product of mixing conductive filler particles with liquid-form polymer in granule-forming conditions at a low level of shear whereby the conductive filler particles remain substantially structurally intact.

28. The composite according to claim 27 wherein in such mixing and granule formation were accompanied by cross-linking of the polymer, and the polymer formulation selected and the conditions of mixing controlled so that breakage of the mixture into granules was synchronized with cross-linkage of the polymer sufficient for a non-sticky state.

29. An electrical circuit or electromagnetic shield comprising a conductor composite according to claim 20.

30. Circuit according to claim 29 which is a temperature sensor based on PTC and comprises mechanical or electrostatic means to bring the conductor composite to a conductive state when response to temperature is required, said composite providing a PTC effect by switching to an insulating state in response to thermal expansion due to excess current.

31. Circuit according to claim 30 in which the means bringing the composite to the conductive state is or includes shrinkage of the polymer during preparation of the granules.

32. The composite according to claim 20 further comprising a containing means for the granular composition, said containing means comprising a non-conducting matrix, or supporting sheet.

33. The composite according to claim 32 wherein said non-conducting matrix comprises an elastomeric material.

34. The composite according to claim 33 wherein said supporting sheet comprises a continuous metallized cloth.

* * * * *